US012364918B2

(12) United States Patent
Perron

(10) Patent No.: US 12,364,918 B2
(45) Date of Patent: Jul. 22, 2025

(54) SWIMMING PACING SYSTEM

(71) Applicant: ALIZEM INC., Levis (CA)

(72) Inventor: Marc Perron, Levis (CA)

(73) Assignee: ALIZEM INC., Levis (CA)

( * ) Notice: Subject to any disclaimer, the term of this patent is extended or adjusted under 35 U.S.C. 154(b) by 107 days.

(21) Appl. No.: 18/520,219

(22) Filed: Nov. 27, 2023

(65) Prior Publication Data

US 2024/0173610 A1 May 30, 2024

Related U.S. Application Data

(60) Provisional application No. 63/385,072, filed on Nov. 28, 2022.

(51) Int. Cl.
*A63B 71/06* (2006.01)
*A63B 69/12* (2006.01)

(52) U.S. Cl.
CPC ..... *A63B 71/0686* (2013.01); *A63B 69/12* (2013.01); *A63B 2220/13* (2013.01); *A63B 2225/50* (2013.01); *A63B 2225/60* (2013.01); *A63B 2225/74* (2020.08)

(58) Field of Classification Search
CPC . A63B 71/0686; A63B 69/12; A63B 2220/13; A63B 2225/50; A63B 2225/60; A63B 2225/74; A63B 2071/0625; A63B 2071/0694; A63B 2220/833; A63B 71/0622
See application file for complete search history.

(56) References Cited

U.S. PATENT DOCUMENTS

| | | | | |
|---|---|---|---|---|
| 6,086,379 | A | 7/2000 | Pendergast et al. | |
| 8,317,659 | B2 | 11/2012 | Woodson | |
| 8,472,285 | B2 | 6/2013 | Day | |
| 9,067,121 | B1 * | 6/2015 | Beard | A63B 31/00 |
| 9,266,006 | B2 | 2/2016 | Herold | |
| 9,778,622 | B2 | 10/2017 | Firmin | |
| 10,102,686 | B2 | 10/2018 | Oberhelman et al. | |
| 10,627,076 | B2 | 4/2020 | Chapman et al. | |
| 2006/0176686 | A1 | 8/2006 | McVicker | |

(Continued)

FOREIGN PATENT DOCUMENTS

| | | | |
|---|---|---|---|
| AU | 2014203822 | A1 | 1/2016 |
| CN | 201378413 | Y | 1/2010 |

(Continued)

OTHER PUBLICATIONS

"LumaLanes Swim Pacing system", LumaLanes User's Manual, 2023, 36 pages.

(Continued)

*Primary Examiner* — Sundhara M Ganesan
(74) *Attorney, Agent, or Firm* — Adler Pollock & Sheehan P.C.

(57) ABSTRACT

A swimming pacing system is provided and includes at least one visual indicator connectable to a pool line extending between opposite pool edges of a swimming pool. Each visual indicator has an indicator housing and a light source received in the indicator housing, a controller operatively connected to the at least one visual indicator to control activation of the light source in accordance with a desired pattern or sequence.

20 Claims, 6 Drawing Sheets

(56) References Cited

U.S. PATENT DOCUMENTS

| | | | | |
|---|---|---|---|---|
| 2008/0171310 | A1* | 7/2008 | Wiles ..... | A63B 69/12<br>434/203 |
| 2011/0151748 | A1 | 6/2011 | Warren et al. | |
| 2014/0024501 | A1 | 1/2014 | Tabena Isern et al. | |
| 2016/0077660 | A1 | 3/2016 | Frantz et al. | |
| 2016/0306603 | A1 | 10/2016 | Nadeson | |
| 2016/0332018 | A1 | 11/2016 | Granat et al. | |

FOREIGN PATENT DOCUMENTS

| | | | |
|---|---|---|---|
| FR | 3033254 | A1 | 9/2016 |
| PL | 414117 | A1 | 3/2017 |

OTHER PUBLICATIONS

Szczepan , et al., "Validation of the New Visual Swimming Pace Control System in Real-time", Central European Journal of Sport Sciences and Medicine, vol. 19, No. 3, 2017, pp. 93-104.

* cited by examiner

SWIMMING PACING SYSTEM

CROSS-REFERENCE TO RELATED APPLICATIONS

This application claims priority under 35USC§ 119(e) of U.S. Provisional Application No. 63/385,072 filed Nov. 28, 2022, entitled "SWIMMING PACING SYSTEM", the entirety of which is hereby incorporated by reference.

TECHNICAL FIELD

The technical field generally relates to timers and pacers used in sports, and more specifically to pacing systems for use in swimming.

BACKGROUND

Pacing systems, or pacers, are useful in providing information to a swimmer swimming lengths or laps information about their length or lap time. For example, it may be desirable to maintain the same lap time over a certain predetermined number of consecutive laps. In some case, it can also be desirable to decrease or increase the swimmer's lap time from lap to lap.

Currently, swimmers sometimes rely on analog timers that are positioned near the pool (e.g., hung on a wall in an indoor pool facility). These are sometimes referred to as "pool wall clocks". These pool wall clocks are found in most public pools and typically include arrows revolving at a set pace of one turn per minute, thereby requiring the swimmer to perform calculations at each lap to know where the arrow should be to match his desired pace and adjust swim speed accordingly. The pool wall clock can also be difficult to read for people who usually wear glasses and, in any case, requires the swimmer to look in the direction of the pool wall clock, with head above water, thereby breaking the swimmer's stride. The location of the pool wall clock and ceiling lighting for indoor pools or sunlight for outdoor pools may further prevent the swimmer from properly viewing the pool wall clock.

Other timers currently used by swimmers include sports watches and waterproof timers that can be placed on or under the swimmer's cap, for example. Obviously, these reduce the swimmer's comfort and hydrodynamics and prevent the swimmer from maintaining a good swimming form. These timers can emit a sound or a vibration at a certain interval, but this sound or vibration may be hard to perceive underwater. These timers send signals that can be perceived by the swimmers only, not the coaches. It would be useful to provide access to those signals to coaches and/or other parties.

There is therefore a need for a device that would overcome or alleviate at least one of the above-identified drawbacks.

SUMMARY

According to one aspect, there is provided a swimming pacing system comprising: at least one visual indicator attachable to a pool line extending between opposite pool edges of a swimming pool, each visual indicator including an indicator housing and a light source received in the indicator housing; a controller operatively connect to the at least one visual indicator to control activation of the light source in accordance with a desired pattern or sequence.

In at least one embodiment, the light source includes one or more light-emitting diodes (LED).

In at least one embodiment, the one or more LEDs include a first set of LEDs having a first color and a second set of LEDs having a second color.

In at least one embodiment, the indicator housing is substantially annular.

In at least one embodiment, each visual indicator includes an attachment portion for attaching the visual indicator to the pool line.

In at least one embodiment, the attachment portion is defined by a structure of the indicator housing.

In at least one embodiment, the controller includes a smartphone or a tablet.

In at least one embodiment, the controller includes a dedicated controller.

In at least one embodiment, the controller includes a processing unit, a memory operatively connected to the processing unit, a communication unit operatively connected to the processing unit to provide commands to the at least one visual indicator and a user interface to allow a user to input data into the controller.

In at least one embodiment, the controller is configured to activate the light source at a desired interval for a desired activation period.

In at least one embodiment, the controller is configured to activate the light source at a constant interval.

In at least one embodiment, the controller is configured to activate the light source at varying intervals.

In at least one embodiment, the controller is configured to activate the light source at a constant light intensity during the desired activation period.

In at least one embodiment, the controller is configured to activate the light source according to a certain pattern during the desired activation period.

In at least one embodiment, the controller is configured to activate only a portion of the light source during the desired activation period.

In at least one embodiment, the at least one visual indicator includes a first visual indicator located proximal to one of the pool edges and a second visual indicator located proximal to the other one of the pool edges.

In at least one embodiment, the at least one visual indicator includes a plurality of visual indicators spaced from each other along the pool line between the opposite pool edges.

In at least one embodiment, the at least one visual indicator includes an elongated visual indicator adapted to extend along a length of the pool line.

In at least one embodiment, the at least one visual indicator includes a single elongated visual indicator adapted to extend along substantially an entire length of the pool line.

In at least one embodiment, the swimming pacing system further includes a sensor positionable within the pool and operatively connected to the controller, the sensor being configured to detect a presence of the swimmer at the corresponding location of the sensor.

DETAILED DESCRIPTION

As will be explained below in relation to various embodiments, the present disclosure describes devices, systems and methods for assisting athletes, such as swimmers, to train while keeping track of important information with little or no distractions and/or unnecessary movements.

In some embodiments, the present disclosure describes a swimming pacing system provided with a visual indicator attachable to a pool line. The visual indicator includes an indicator housing and a light source housed within the indicator housing. A controller is operatively connected to the light source in order to control activation of the light source in accordance with a desired pattern or sequence. As such, the swimmer can swim laps across the length of the pool and maintain eye contact with the visual indicator without breaking his concentration and without having to stop swimming. Therefore, the swimmer can adjust, if necessary, any one parameter (e.g., speed, pace, etc.) during his training session.

Figure 1:
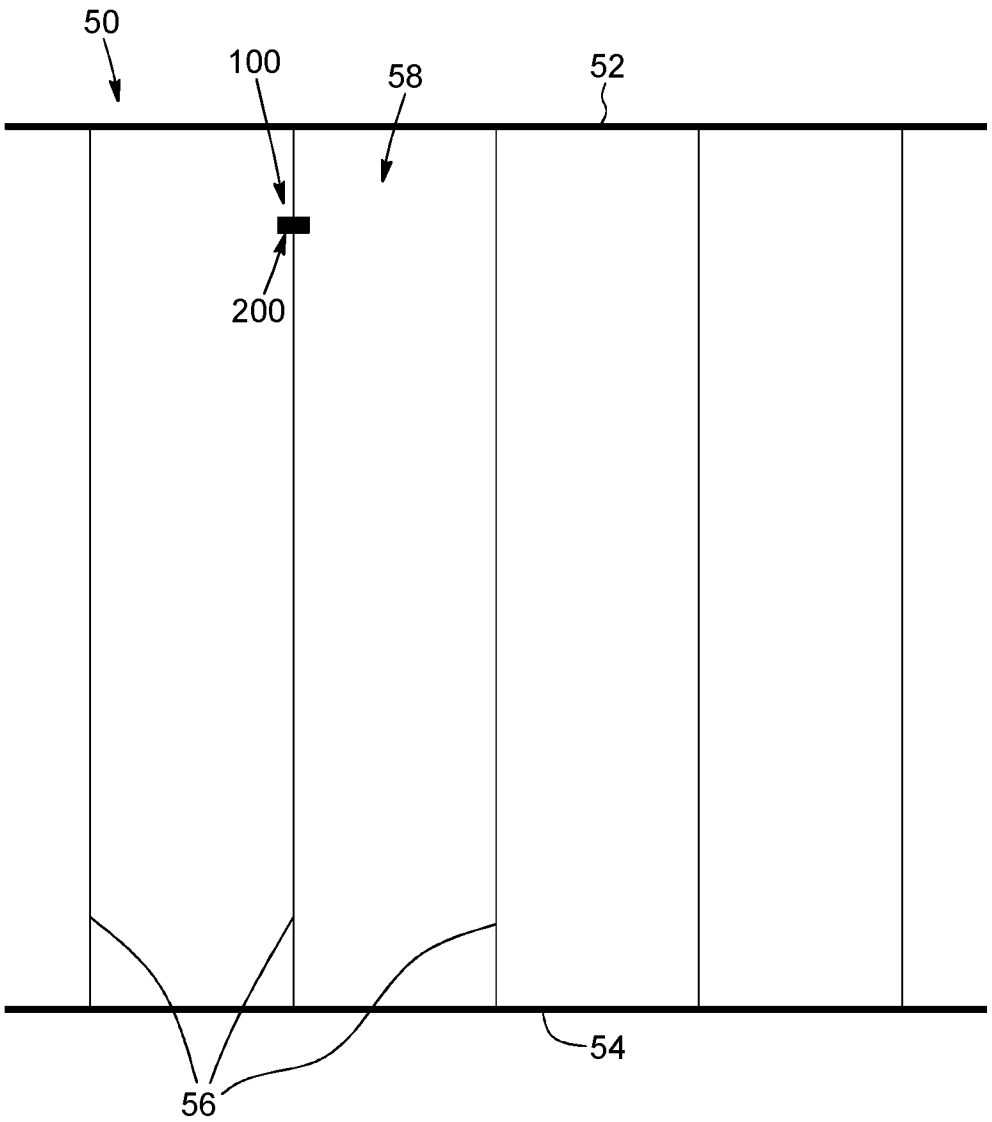
FIG. 1 is a schematic top plan view of a swimming pacing system provided in a swimming pool, in accordance with one embodiment.
Figure 2:
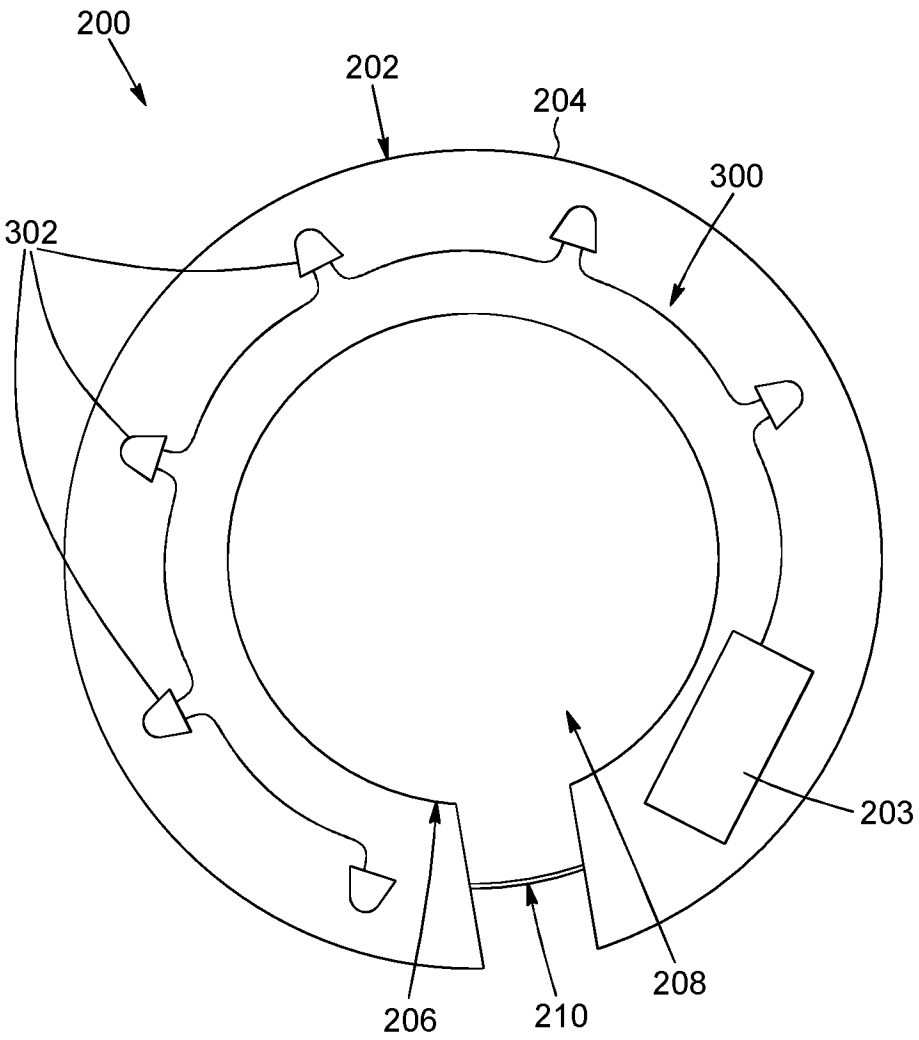
FIG. 2 is a schematic view of a visual indicator of the swimming pacing system illustrated in FIG. 1, according to an embodiment.
Figure 3:
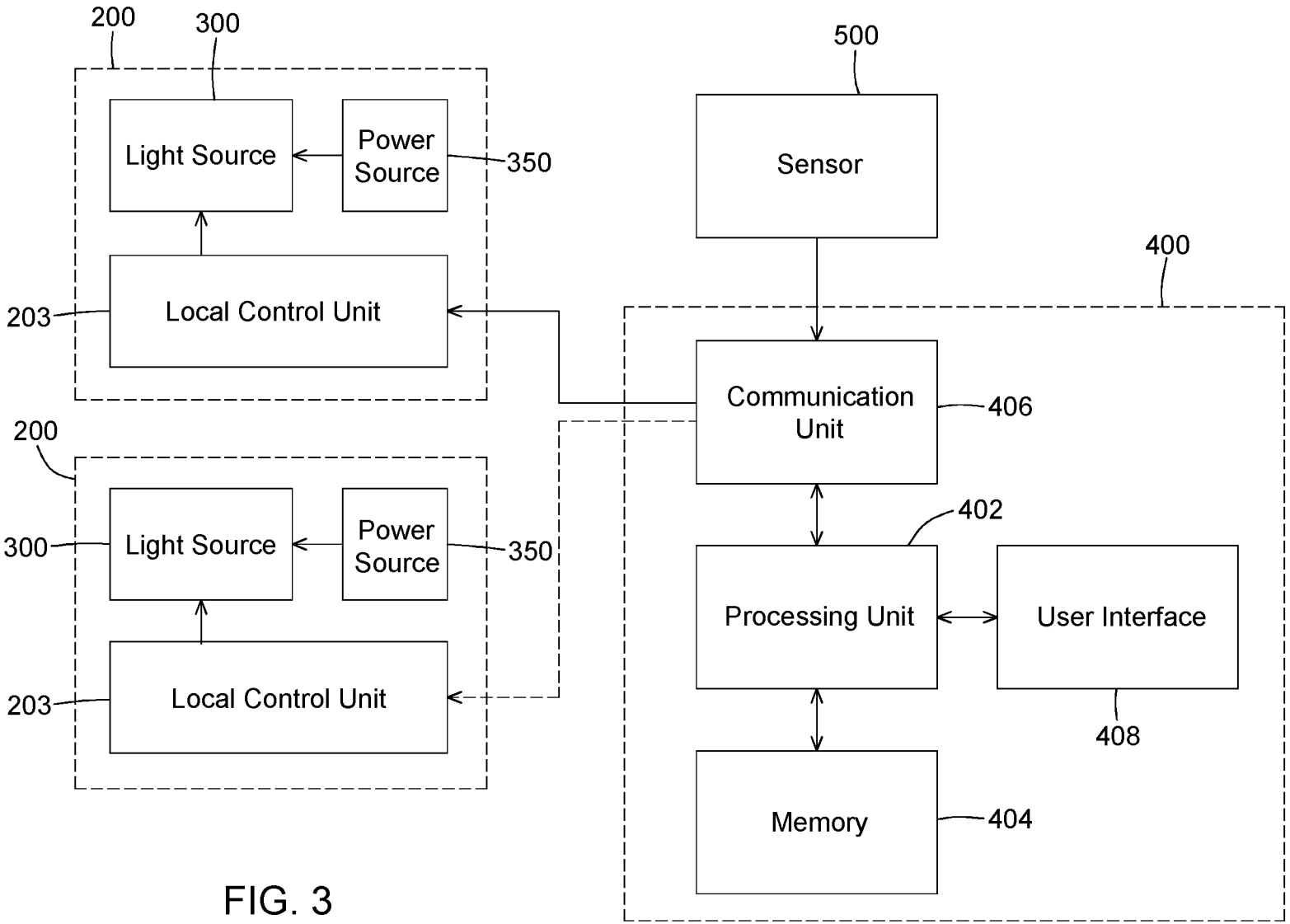
FIG. 3 is a block diagram of the swimming pacing system illustrated in FIG. 1, according to an embodiment.

Referring to FIGS. 1 to 3, a swimming pacing system 100 for use in swimming, and more particularly in swimming in a swimming pool 50 is shown. The swimming pacing system 100 can be used to provide information to a swimmer swimming laps in the swimming pool such as lap times, pacing, number of laps performed or number of laps remaining according to a predetermined training program, for example. The swimming pacing system 100 can be used for swimming training, including individual or group training, competitive training and fitness training, or for recreational purposes.

Swimming pools, such as swimming pool 50 illustrated in FIG. 1, typically include at least one pair of opposite edges, such as first and second pool edges 52, 54, which are spaced apart from each other and substantially parallel to each other. The swimming pool 50 can further include a plurality of pool lines 56 which extend between the first and second pool edges 52, 54, substantially perpendicular thereto, and which are spaced from each other to define pool lanes 58 therebetween. This configuration allows a swimmer to swim "laps" in one of the pool lanes 58 by swimming back and forth between the first and second pool edges 52, 54. In some embodiments, the swimming pool 50 has a length, defined between the first and second pool edges 52, 54, of about 25 or 50 meters, which are typical standard pool lengths. Alternatively, it should be noted that the swimming pool 50 can have any other length.

In some embodiments, the swimming pacing system 100 includes one or more visual indicators 200, such as a light source 300, configured to provide a visual indication (e.g., visual signal, visual cue or warning, etc.) to the swimmer. The swimming pacing system 100 further includes a controller 400 operatively connected to the visual indicators 200 to control activation of the light source 300 in accordance with a desired pattern or according to one or more conditions.

As seen in FIGS. 2 and 3, the visual indicator 200 includes an indicator housing 202, with the light source 300 being received within the indicator housing 202. In the illustrated embodiment, the light source 300 includes a plurality of light-emitting diodes or LEDs 302 disposed along the indicator housing 202. At least some of the LEDs 302 can be configured to be activatable and deactivatable independently from each other. For example, this configuration can allow the light source 300 to produce light at different intensities which can be used to provide different visual signals to the swimmer and other parties such as a coach standing along the edge of the pool.

In one embodiment, the LEDs 302 can include a first set of LEDs having a first color and a second set of LEDs having a second color different from the first color. It should therefore be noted that activating the first set of LEDs can provide a first signal to the swimmer (e.g., information #1), while activating the second set of LEDs can provide a second signal to the swimmer (e.g., information #2). Alternatively, or additionally, the LEDs 302 can include a multi-colored LED which can be selectively set to one of a plurality of color, each color corresponding to one of a plurality of signals to be provided to the swimmer. In yet another embodiment, the LEDs 302 can include a plurality of multi-colored LEDs, a combination of one or more multi-colored LEDs and/or one or more single-color LED, or any other suitable arrangement of LEDs. It is appreciated that each color, intensity and/or blinking pattern of the visual indicator can be linked to respective informational values.

In the illustrated embodiment, the light source 300 further includes a power source 350 operatively connected to the LEDs. The power source can include one or more rechargeable batteries, one or more disposable batteries or any other suitable source of power to power the LEDs. In some embodiments, each set of LEDs 302 can be provided with respective power sources 350. Alternatively, a single power source 350 can be configured to provide power to each set of LEDs within the indicator housing. Similarly, when the controller 400 is included in the indicator housing 202, the light source 300 and the controller 400 can be operatively connected to a common power source 350 or to respective power sources 350. In other words, a single power source 350 can be provided within the indicator housing 202 and operatively connected to each component requiring electrical power.

In one embodiment, the visual indicator 200 further includes a local control unit 203 received in the indicator housing 202 and operatively connected to the light source 300 to receive commands from the controller 400 and activate the light source 300, for instance, according to the received commands. In this embodiment, the controller 400 is remote from the visual indicator 200 and is connected to the visual indicator 200 wirelessly. Alternatively, the controller 400 can be located within the indicator housing 202 and operatively connected to the light source 300 via a wired connection to directly activate the light source 300. In such embodiments, the visual indicator 200 can further include a local user interface that would allow the swimmer to directly input data into the controller 400.

The indicator housing 202 is configured to allow the light source 300 to be visible from an exterior of the indicator housing 202. In this embodiment, the indicator housing 202 includes a substantially transparent or translucent housing sidewall 204. Alternatively, the housing sidewall 204 can include a main portion which is opaque and one or more window portions or diffuser portions which are substantially transparent or translucent, with the light source (e.g., different LEDs) being visible through the window portions or diffuser portions. In some embodiments, the light source is visible along a full pool length. In other words, the light source can be positioned at the first pool edge and be visible by a swimmer or another person (e.g., a coach) positioned near the second pool edge. For example, after a swimmer has performed his/her turning motion (flip turn) at the side of the pool opposite the location of the swimming pacing system 100, the light source can be seen. As such, information can be communicated to the swimmer, who acquires said information based on the observed visual signal (e.g., desired/chosen pattern, color, intensity, etc.). For instance, after having performed the flip turn, the swimmer can determine if the predetermined/chosen pace is being respected and adjust accordingly.

In some embodiments, the visual indicator 200 is configured to be positioned in the swimming pool 50. More specifically, and with reference to FIG. 2, the visual indicator 200 includes an attachment portion 206 which allows the visual indicator 200 to be attached to a structure of the swimming pool so as to be readily visible by the swimmer, for instance, when swimming in one of the pool lanes 58. The attachment portion 206 can be integrally formed in the indicator housing 202 or can extend away from the indicator housing 202. In the illustrated embodiment, the indicator housing 202 itself defines the attachment portion 206. More specifically, the indicator housing 202 is substantially annular or toroidal and includes a central opening 208 which is shaped and sized to receive one of the pool lines 56 which defines the pool lane 58.

It will be appreciated that attaching the visual indicator 200 to the pool line 56 allows the visual indicator to be at or near a surface of the water and therefore at or near a level of the swimmer's head, which can increase the visibility of the visual indicator 200 by the swimmer during swimming. As such, it is noted that the amount of effort required for the swimmer to observe the visual indicator and assess the provided information (e.g., predetermined/chosen pattern, color(s), intensity, etc.) is reduced. However, it is appreciated that the attachment portion can be configured to attach the visual indicator to any other suitable structure of the pool, such as the pool floor or along the pool wall, for example.

In another embodiment, the attachment portion 206 can instead include a hook member extending away from the indicator housing 202 and which is sized and shaped to engage one of the pool lines 56. In yet another embodiment, instead of engaging the pool line 56, the attachment portion 206 can be configured to engage another structure of the swimming pool 50 such as one of the pool edges 52, 54 or any other feature(s) defined on the pool edges, pool walls and/or pool floor and on which a hook member may latch on.

In the embodiment illustrated in FIG. 1, the swimming pacing system 100 includes a single visual indicator 200 which is connected to one of the pool lines 56 to engage and provide information to the adjacent pool lanes 58. Therefore, it is noted that multiple swimmers, using either the same pool lane 58 and/or adjacent pool lanes 58, can use the same visual indicator during training. The visual indicator 200 is illustratively located substantially proximal to the first pool edge 52, although it can be positioned at any other suitable position along the pool line 56, along any one of the pool edges 52, 54, or at any other suitable location.

In some embodiments, the indicator housing 202 includes a latch 210 operable between an open position, where the pool line 56 can be inserted in the central opening 208, and a closed position, where the pool line 56 is held in the central opening 208 and is prevented from being removed from the indicator housing 202. The latch 210 can have any suitable configuration. Alternatively, the housing 202 may not include a latch, and can include two halves which are hingeably engaged with each other and openable to engage the pool line 56, or any other suitable mechanism to allow the pool line 56 to be inserted in the central opening 208.

In one embodiment, the housing sidewall 204 is made of a waterproof and water-resistant material such as a polymer, including silicone or a silicone-based polymer, polyethylene (PE), polyvinyl chloride (PVC) or any other suitable material.

Referring to FIG. 3, the controller 400 includes a processing unit 402, a memory 404 operatively connected to the processing unit 402, a communication unit 406 also operatively connected to the processing unit 402 and a user interface 408 to allow the swimmer or another user, such as a swimming coach, to input data into the controller 400. The inputted data entered using the user interface 408 is received by the processing unit 402, which is configured to provide commands to the light source 300 via the communication unit 406. In some embodiments, the communication unit 406 can be wirelessly connected to the local control unit 203 within the indicator housing 202, and operable to activate the light source 300 based on the inputted data. The controller 400 can further include one or more preprogrammed sets of instructions stored in the memory 404, with the processing unit 402 being configured for activating the light source 300 based on the preprogrammed set(s) of instructions.

In one embodiment, the controller 400 can include a smartphone (e.g., linked to an app), a general-use personal computer or any other device which includes an appropriate software or application, and which may be able to communicate remotely with the local control unit 203 and provide commands thereto to control the light source 300. In another embodiment, the controller 400 can include a dedicated controller which can be housed in a waterproof enclosure and be positioned near or in the swimming pool 50 to be easily accessible to the swimmer, for example.

In some embodiments, the controller 400 can be configured to activate the light source 300 according to a desired illumination pattern and/or sequence. For example, the controller 400 can be configured to activate the light source 300 at a desired interval for a desired activation period. More specifically, the light source 300 can be activated at a regular interval such that a period between activations is constant. This would provide an indication to the swimmer swimming laps that they are swimming at a substantially constant speed. For instance, the programmed sequence can make it so that the light source 300 activates when the swimmer is supposed to accomplish a flip turn (i.e., when the swimmer is supposed to have reached an edge of the pool). Therefore, if the swimmer gets to an edge of the pool and the light source is activated, the swimmer can maintain the current pace. Inversely, if the light source is deactivated, the swimmer can adjust (e.g., speed up or slow down) accordingly.

In another embodiment, the light source 300 can be activated at varying intervals. For instance, in some training programs, the period between activations may be successively reduced to provide a signal to the swimmer to increase their speed. Similarly, the controller 400 can be configured to activate the light source 300 at a constant light intensity during the entire activation period. Alternatively, the controller 400 can be configured to increase or decrease the light intensity during the activation period.

The controller 400 can also be configured to activate the light source 300 according to a certain pattern during the activation period. For example, the controller 400 may be configured to activate and subsequently deactivate the light source 300 substantially quickly, which would provide a "flash" of the light source 300. The controller may be configured to provide a certain number of flashes of the light source 300 corresponding to a number of laps performed since a start of a training sequence or a number of laps remaining in a training sequence. The controller may be configured to provide a certain number of flashes based on any other parameter.

In one embodiment, the controller 400 can be configured to activate only a portion of the LEDs during the activation period. For example, in one embodiment, the light source 300 can include ten LEDs. In this embodiment, the controller 400 can be configured to activate a successive number of the LEDs at each activation period, e.g., one LED at a first activation period, two LEDs at a second activation period, etc. Alternatively, the controller 400 can be configured to activate a decreasing number of LEDs at each activation period, corresponding to a number of laps remaining in a training sequence. For example, ten LEDs can be activated at the first activation period, nine LEDs at the second activation period, etc.

In one embodiment, the controller 400 can be configured to activate the first set of LEDs having a first color and the second set of LEDs having a second color according to a desired pattern. For example, the first set of LEDs can be activated to provide to the swimmer a signal that a certain remaining number of laps remain according to a predetermined training program, or that the training program is over.

Figure 6:
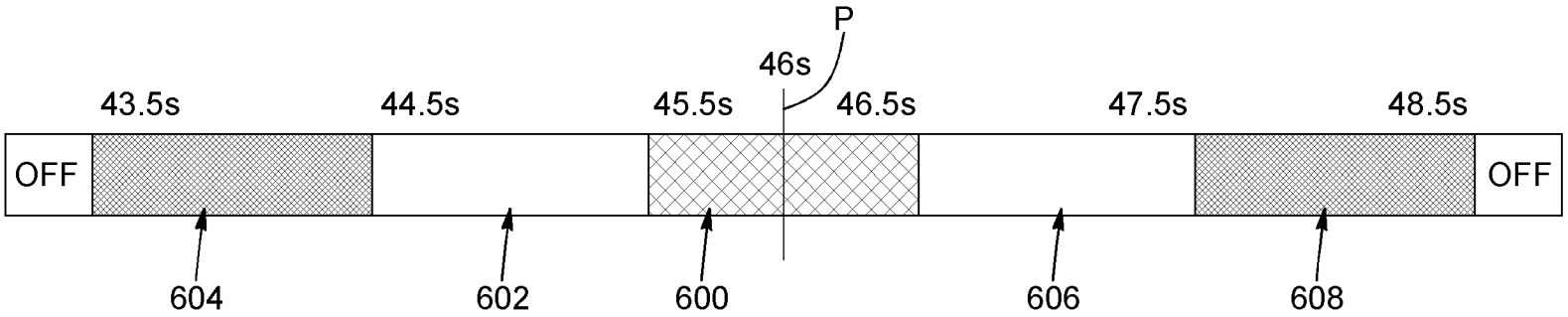
FIG. 6 is a diagram showing an activation sequence for the swimming pacing system set in a continuous mode, in accordance with an embodiment.

In one embodiment, the controller 400 can be configured to provide at least one of an anterior signal prior to a target pace and a posterior signal after a desired target pace P. For example, and with reference to FIG. 6, the target pace P can be set at 46 seconds per 50 meters, which, in a 25-meter pool, corresponds to the swimmer swimming from the first pool edge 52 to the second pool edge 54 and back from the second pool edge to the first pool edge 52. This target pace P corresponds to a length of a pacing cycle, which represents the interval between successive signals provided to the swimmer. It is noted that the target pace P can be set by the swimmer, or can be pre-set in the controller 400 and not adjustable by the swimmer.

In the illustrated embodiment, the controller 400 is configured to activate the light source 300 such that the light source 300 is illuminated at a target pace color, such as green, during a target pace time period 600 comprising the target pace P. Specifically, in this embodiment, the target pace P is substantially centered in the target pace time period 600 and the target pace time period 600 is of about one second in length, such that the target pace time period 600 starts at about 45.5 seconds from a beginning of the pacing cycle and ends at about 46.5 seconds from the beginning of the pacing cycle. In this embodiment, the light source 300 is therefore illuminated at the target pace color continuously between the start and the end of the target pace time period 600.

In some embodiments, the anterior signal, or the visual signal provided prior to the target pace signal (e.g., the green light), includes an activation of the light source before the target pace time period at one or more colors different from the target pace color. For example, the anterior signal is provided during a proximal anterior time period 602 extending before the target pace time period and a distal anterior time period 604 extending before the proximal anterior time period 602. The light source 300 is configured to be illuminated at a proximal anterior color different from the target pace color, such as yellow, during the proximal anterior time period 602 and at a distal anterior color different from the target pace color and the proximal anterior color, such as red, during the distal anterior time period 604.

In the illustrated embodiment, the distal anterior time period 604, the proximal anterior time period 602 and the target pace time period 600 are contiguous to each other and each one of the periods has a length of about one second. The distal anterior time period 604 therefore starts at about 43.5 seconds from the beginning of the pacing cycle and ends at about 44.5 seconds, while the proximal anterior time period 602 starts at about 44.5 seconds from the beginning of the pacing cycle and ends at about 45.5 seconds.

Similarly, the posterior signal, or the visual signal provided after the target pace signal (e.g., the green light), includes an activation of the light source after the target pace time period 600 at one or more colors different from the target pace color. Specifically, the anterior signal is provided during a proximal posterior time period 606 extending after the target pace time period and a distal posterior time period 608 extending after the proximal anterior time period. The light source 300 is configured to be illuminated at a proximal posterior color different from the target pace color, such as yellow or blue, during the proximal posterior time period 606 and at a distal posterior color different from the target pace color and the proximal posterior color, such as red or white, during the distal posterior time period 608.

In the illustrated embodiment, the target pace time period 600, the proximal posterior time period 606 and the distal posterior time period 608 are contiguous to each other and each one of the periods has a length of about one second. The proximal posterior time period 606 therefore starts at about 46.5 seconds from the beginning of the pacing cycle and ends at about 47.5 seconds, while the distal posterior time period 608 starts at about 47.5 seconds from the beginning of the pacing cycle and ends at about 48.5 seconds.

In this embodiment, when the swimmer approaches the first pool edge 52 from the second pool edge 54, the swimmer will first see the visual indicator 200 emit red light, thereby providing a signal to the swimmer indicating that 43.5 seconds have elapsed since the beginning of the pacing cycle. The swimmer will then see the visual indicator 200 emit yellow light, thereby providing to the swimmer a signal indicating that 44.5 seconds have elapsed since the beginning of the pacing cycle, and finally emit green light, thereby providing to the swimmer a signal indicating that 45.5 seconds have elapsed since the beginning of the pacing cycle. In this embodiment, the swimmer can adjust his/her swimming speed to avoid touching the first pool edge 52 and/or turning to swim in the opposite direction while the visual indicator 200 emits a light having a color other than green, which correspond to the distal and proximal anterior time periods, and to touch the first pool edge 52 and/or turn to swim in the opposite direction when the visual indicator 200 emits green light.

Before touching the first pool edge 52 and/or turning, the swimmer may further see the indicator 200 emit yellow (or blue) light after emitting green light, thereby providing to the swimmer a signal indicating that 46.5 seconds have elapsed since the beginning of the pacing cycle, and may even see indicator 200 emit red (or white) light after emitting yellow (or blue) light, thereby providing to the swimmer a signal indicating that 47.5 seconds have elapsed since the beginning of the pacing cycle. In this case, the swimmer may want to increase his/her speed slightly on the following lap to catch up to the pace on the next pacing cycle.

In one embodiment, the controller 400 may be selectively configured in one of a plurality of operating modes, each operating mode corresponding to a certain illumination pattern of the light source. More specifically, the controller 400 can be configurable in a continuous mode corresponding to the above-described illumination pattern. In the continuous mode, the swimming pacing system 100 is configured to keep repeating successive pacing cycles until the swimming pacing system 100 is deactivated by the swimmer.

The controller 400 may further be configurable in a distance mode in which the controller provides to the swimmer a lap number indication corresponding to a number of laps performed by the swimmer since the activation of the swimming pacing system 100. In this distance mode, the swimmer may input a desired number of laps to be performed at a predetermined pace, for example, sixteen (16) laps, into the controller. When activated, the swimming pacing system 100 can operate similar to the continuous mode during the first seven (7) laps. At the eighth lap, the swimming pacing system 100 is illuminated in the successive time periods described above using the corresponding colors of each time period as in the continuous mode, except that instead of being illuminated continuously in each time period, the light source 300 flashes repeatedly (e.g., blinks) during each time period. This provides an indication that the swimmer is currently swimming the eighth lap, e.g., that the swimmer is substantially halfway through the desired number of laps. In one embodiment, the light source 300 may also blink in this manner during the penultimate lap, e.g., the fifteenth lap in this case, to provide an indication to the swimmer that a single lap remains before the desired number of laps to be performed are completed. In one embodiment, the swimming pacing system 100 may then be automatically deactivated once the desired number of laps has been completed.

Referring back to FIG. 3, in some embodiments, the swimming pacing system 100 can include a sensor 500 operatively connected to the controller 400. Specifically, the sensor 500 can be positioned at any suitable location in the pool 50, such as near one of the first and second pool edges 52, 54, and be used to detect the presence of the swimmer at the location of the sensor. For example, the sensor 500 can be a contact sensor provided on the pool edge 52, 54 or in the pool 50 near the pool edge 52, 54, or can be a proximity sensor which would detect a presence of the swimmer near the corresponding pool edge 52, 54.

The controller 400 can be configured to receive from the sensor 500 an indication of a detection of the swimmer's presence and provide a signal to the swimmer based on this detection. For example, the controller 400 can be configured to calculate a lap time of the swimmer based on a period between successive detections of the swimmer's presence near the corresponding pool edge 52, 54 and to activate the light source 300 in a certain pattern or sequence which would provide an indication to the swimmer that a lap was faster or slower than a previous lap, for example. Similarly, the number of laps performed by the swimmer can be calculated based on the number of successive detections of the swimmer's presence by the sensor 500.

In one embodiment, the controller 400 can be configured to store data in the memory 404 based on the indication of the detection received from the sensor 500. For example, the controller 400 can be configured to store the data, such as recorded lap times and/or a number of laps swam, for example, in the memory 404 to be accessed later by the swimmer.

It will be understood that the swimming pacing system 100 can be provided to consumers in one of various configurations including different combinations of the features described above. For example, three different embodiments of the swimming pacing system 100 can be offered for sale to consumers. In a first embodiment, the controller 400 may be configured such that the swimming pacing system 100 may only be operated in the continuous mode described above, such that the pacing (e.g., the interval between successive activations of the light source 300) is predetermined and is not adjustable by the user. Therefore, in the first embodiment, it is noted that the controller 400 does not include a device, such a smartphone or the like, having a communication unit configured to communicate remotely with the visual indicator(s) 200, and is not configured to communicate with such a remote device.

In a second embodiment, the controller 400 may be configured such that the swimming pacing system 100 may be selectively operated in different modes, such as the continuous mode and the distance mode described above, such that the pacing is predetermined and can only be adjusted between the preprogrammed modes and cannot be further adjusted by the user. Therefore, in the second embodiment, it is noted that the controller 400 does not include a device, such a smartphone or the like, having a communication unit configured to communicate remotely with the visual indicator(s) 200, and is not configured to communicate with such a remote device.

In a third embodiment, the controller 400 may be configured such that the swimming pacing system 100 can be selectively operated in different modes, such as the continuous mode and the distance mode described above, and such that the pacing can be adjusted by the user. It is noted that, in the third embodiment, the controller 400 either includes a device, such a smartphone or the like, having a communication unit configured to communicate remotely with the visual indicator(s) 200 or is configured to communicate with such a remote device.

In one example of use of the swimming pacing system 100, the swimmer may arrive at the swimming pool 50 and attach the visual indicator 200 to the pool line 56 proximal to the first pool edge 52. For instance, the swimmer may position the visual indicator 200 at a certain distance from the first pool edge 52 (e.g., a few feet from the first pool edge 52), rather than adjacent the first pool edge 52. This would allow the swimmer to receive the signal(s) from the visual indicator 200 before he/she reaches the first pool edge 52, which would allow the swimmer to initiate his/her turning motion (e.g., flip turn) before arriving at the first pool edge 52. In one embodiment, the swimmer can set the swimming pacing system 100 in the continuous mode and receive the signal(s) from the visual indicator 200 when approaching the first pool edge 52 from the second pool edge 54 until the swimming pacing system 100 is deactivated. In another embodiment, before or after attaching the visual indicator 200 to the pool line 56, the swimmer can set or program the swimming pacing system 100 in the distance mode and receive the signal(s) from the visual indicator 200 when approaching the first pool edge 52 until the desired number of laps have been performed. In yet another embodiment, before or after attaching the visual indicator 200 to the pool line 56, the swimmer can input data such as a length of the swimming pool, a desired number of laps, a desired pacing, etc., via a remote device (e.g., a smartphone). Alternatively, instead of the swimmer inputting data into the controller 400, the data can be inputted in the controller 400 by another person such as a swimming coach, for example.

Figure 4:
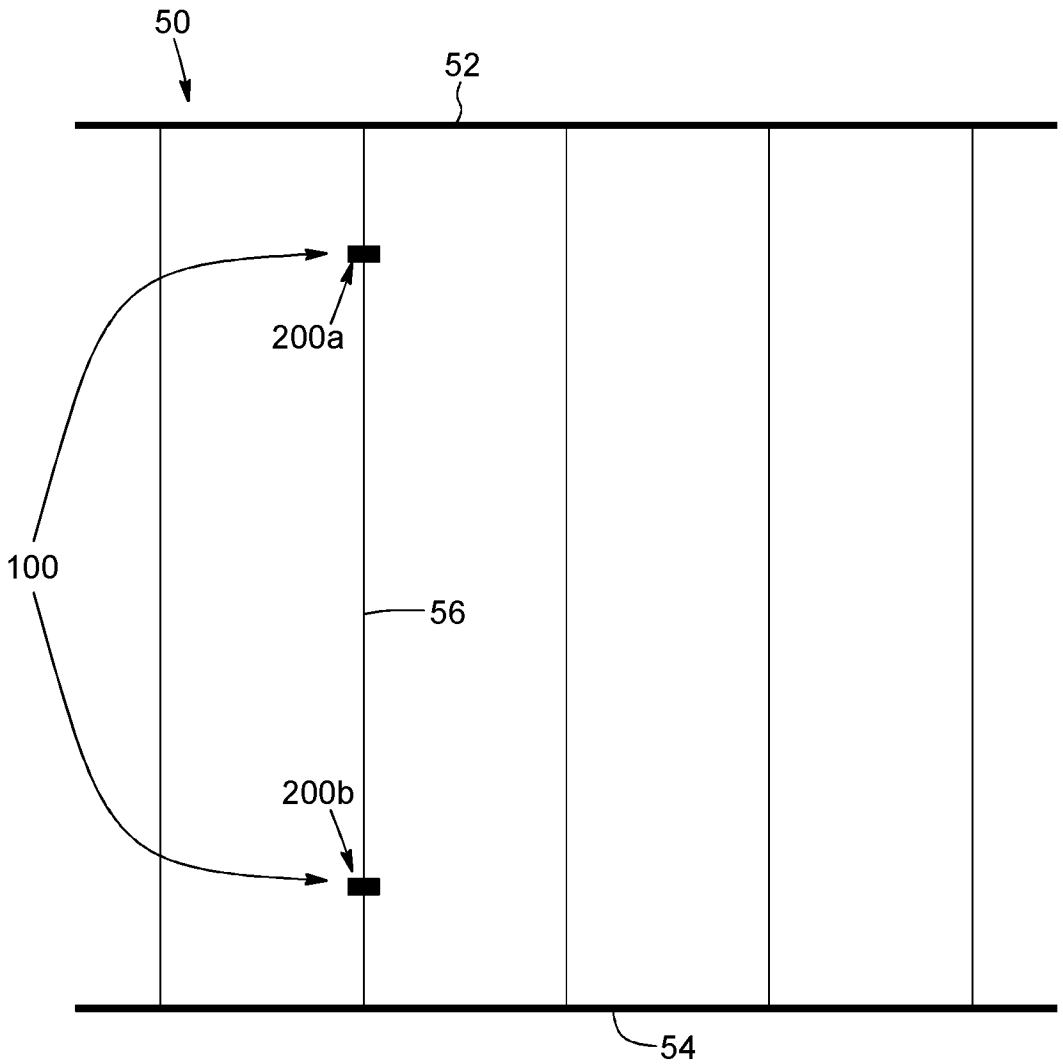
FIG. 4 is a schematic top plan view of a swimming pacing system provided in the swimming pool, in accordance with another embodiment.
Figure 5:
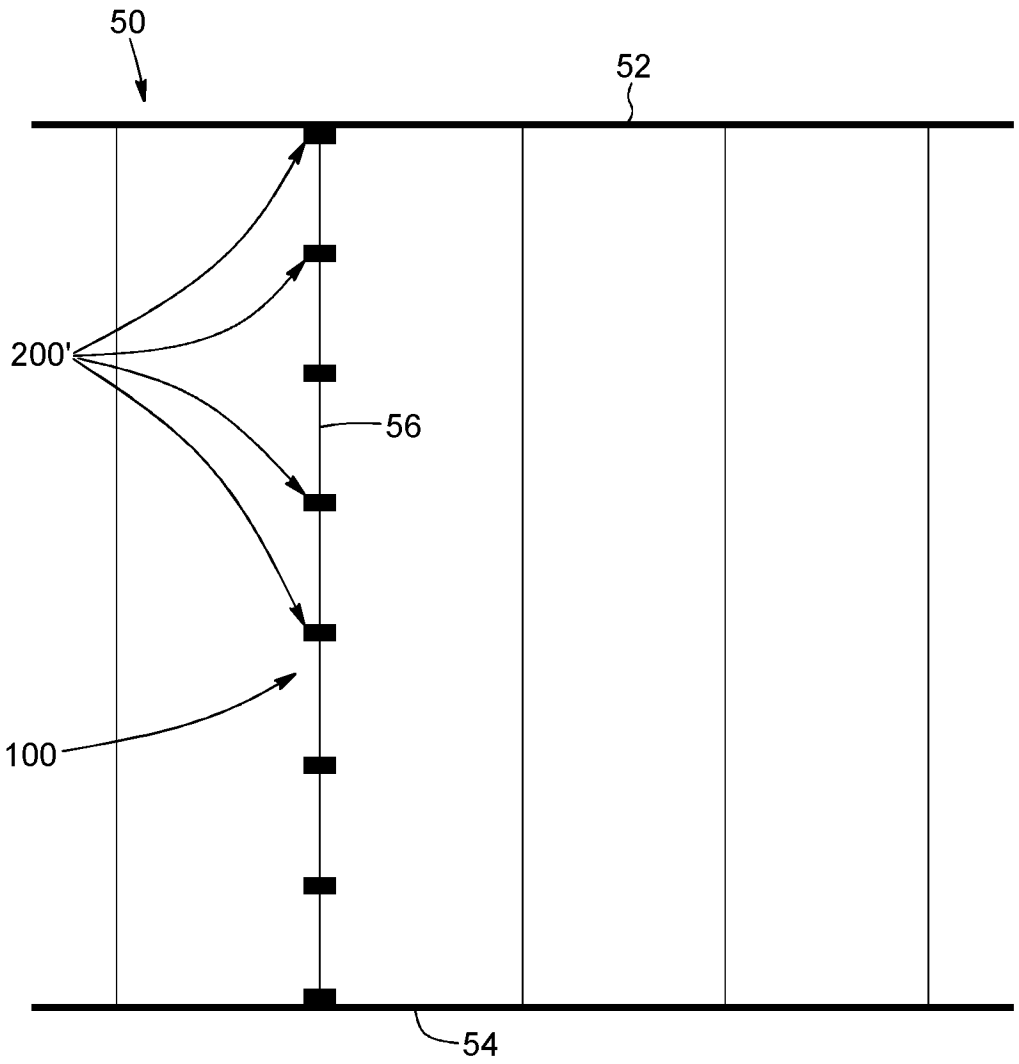
FIG. 5 is a schematic top plan view of a swimming pacing system provided in the swimming pool, in accordance with yet another embodiment.

As shown in FIGS. 4 and 5, the swimming pacing system 100 can include more than one visual indicator 200. For example, in the embodiment illustrated in FIG. 4, the swimming pacing system 100 includes a first visual indicator 200*a* located proximal to one of the pool edges 52, 54 and a second visual indicator 200*b* located proximal to the other one of the pool edges 52, 54. In this embodiment, the swimmer can receive indication from the swimming pacing system 100 at both ends of the pool 50. The visual indicators 200*a*, 200*b* can be configured to automatically synchronize with each other, either via the controller 400 or directly with each other via a direct connection such as a Bluetooth™ connection or the like.

With reference to FIG. 5, the swimming pacing system 100 can include a plurality of visual indicators 200', substantially similar to the visual indicator 200 described above, disposed along the pool line 56. For example, each visual indicator 200' can be spaced from each other by any suitable interval, either evenly and/or unevenly. In this embodiment, the controller 400 is operatively connected to all of the visual indicators 200' and can be configured to activate the light source 300 of each visual indicator 200' simultaneously and/or successively at a certain interval that would correspond to a desired speed of the swimmer. The swimmer can then simply keep up with the activated visual indicator 200' to match their speed to the desired, chosen, programmed and/or inputted speed.

Alternatively, instead of multiple visual indicators 200', the swimming pacing system 100 can include a single, elongated visual indicator which can extend along the pool line, such as along a portion thereof, or along approximately an entire length thereof. In some embodiments, the swimming pacing system 100 can define the pool line itself, with the housing being elongated and configured to be connected at opposite ends thereof to opposite edges of the pool. It will be understood that the elongated housing includes the one or more light sources configured to provide visual signals at any location along the length of the pool (e.g., along the length of the elongated housing). In some embodiments, the single elongated visual indicator and/or the plurality of visual indicators (e.g., seen in FIG. 5) can cooperate with one or more sensors configured to detect the presence of the swimmer. Therefore, the corresponding visual indicator, or corresponding portion of the single elongated visual indicator, can be activated based on the location of the swimmer, which is detected by a corresponding one of the one or more sensors.

It will be understood that the above embodiments are merely provided as examples and that other alternative embodiments may be considered. For example, in addition to the one or more visual indicators, the swimming pacing system can further include other types of indicators such as a sound indicator which can be operatively connected to the controller to provide auditory signals to the swimmer, in addition or as an alternative to the visual signals provided by the one or more visual indicators.

In one embodiment, the swimming pacing system can be used during group training sessions, where multiple swimmers are training (e.g., in the same line or in different lines). The swimming pacing system can be configured to achieve some performance evaluation training similar to a "beep test" or training sessions that can mimic competitive environment games (e.g., variation of intensity similar to an open water swimming race).

The present disclosure may be embodied in other specific forms without departing from the subject matter of the claims. The described example embodiments are to be considered in all respects as being only illustrative and not restrictive.

In the present disclosure, an embodiment is an example or implementation of the truss assembly. The various appearances of "one embodiment," "an embodiment" or "some embodiments" do not necessarily all refer to the same embodiments. Although various features may be described in the context of a single embodiment, the features may also be provided separately or in any suitable combination. Conversely, although the truss assembly may be described herein in the context of separate embodiments for clarity, it may also be implemented in a single embodiment. Reference in the specification to "some embodiments", "an embodiment", "one embodiment", or "other embodiments", means that a particular feature, structure, or characteristic described in connection with the embodiments is included in at least some embodiments, but not necessarily in all embodiments.

As used herein, the terms "coupled", "coupling", "attached", "connected" or variants thereof as used herein can have several different meanings depending in the context in which these terms are used. For example, the terms coupled, coupling, connected or attached can have a mechanical connotation. For example, as used herein, the terms coupled, coupling or attached can indicate that two elements or devices are directly connected to one another or connected to one another through one or more intermediate elements or devices via a mechanical element depending on the particular context.

Similarly, positional descriptions such as "top", "bottom", "above", "under", "below", "left", "right", "front", "rear", "parallel", "perpendicular", "transverse", "inner", "outer", "internal", "external", and the like should, unless otherwise indicated, be taken in the context of the figures and should not be considered limiting.

In the above description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The implementations, geometrical configurations, materials mentioned and/or dimensions shown in the figures are optional, and are given for exemplification purposes only.

In addition, although the optional configurations as illustrated in the accompanying drawings comprises various components and although the optional configurations of the truss assembly as shown may consist of certain geometrical configurations as explained and illustrated herein, not all of these components and geometries are essential and thus should not be taken in their restrictive sense, i.e. should not be taken as to limit the scope of the present disclosure. It is to be understood that other suitable components and cooperations thereinbetween, as well as other suitable geometrical configurations may be used for the implementation and use of the truss assembly, and corresponding parts, as briefly explained and as can be easily inferred herefrom, without departing from the scope of the disclosure.

The invention claimed is:

1. A swimming pacing system comprising:

at least one visual indicator attachable to a pool line extending between opposite pool edges of a swimming pool, each visual indicator including an indicator housing and a light source received in the indicator housing;

a controller operatively connected to the at least one visual indicator to control activation of the light source in accordance with a desired pattern or sequence.

2. The swimming pacing system as claimed in claim 1, wherein the light source includes one or more light-emitting diodes (LED).

3. The swimming pacing system as claimed in claim 2, wherein the one or more LEDs include a first set of LEDs having a first color and a second set of LEDs having a second color.

4. The swimming pacing system as claimed in claim 1, wherein the indicator housing is substantially annular.

5. The swimming pacing system as claimed in claim 1, wherein each visual indicator includes an attachment portion for attaching the visual indicator to the pool line.

6. The swimming pacing system as claimed in claim 5, wherein the attachment portion is defined by a structure of the indicator housing.

7. The swimming pacing system as claimed in claim 1, wherein the controller includes a smartphone or a tablet.

8. The swimming pacing system as claimed in claim 1, wherein the controller includes a dedicated controller.

9. The swimming pacing system as claimed in claim 1, wherein the controller includes a processing unit, a memory operatively connected to the processing unit, a communication unit operatively connected to the processing unit to provide commands to the at least one visual indicator and a user interface to allow a user to input data into the controller.

10. The swimming pacing system as claimed in claim 1, wherein the controller is configured to activate the light source at a desired interval for a desired activation period.

11. The swimming pacing system as claimed in claim 10, wherein the controller is configured to activate the light source at a constant interval.

12. The swimming pacing system as claimed in claim 10, wherein the controller is configured to activate the light source at varying intervals.

13. The swimming pacing system as claimed in claim 10, wherein the controller is configured to activate the light source at a constant light intensity during the desired activation period.

14. The swimming pacing system as claimed in claim 10, wherein the controller is configured to activate the light source according to a certain pattern during the desired activation period.

15. The swimming pacing system as claimed in claim 10, wherein the controller is configured to activate only a portion of the light source during the desired activation period.

16. The swimming pacing system as claimed in claim 1, wherein the at least one visual indicator includes a first visual indicator located proximal to one of the pool edges and a second visual indicator located proximal to the other one of the pool edges.

17. The swimming pacing system as claimed in claim 1, wherein the at least one visual indicator includes a plurality of visual indicators spaced from each other along the pool line between the opposite pool edges.

18. The swimming pacing system as claimed in claim 1, wherein the at least one visual indicator includes an elongated visual indicator adapted to extend along a length of the pool line.

19. The swimming pacing system as claimed in claim 1, wherein the at least one visual indicator includes a single elongated visual indicator adapted to extend along substantially an entire length of the pool line.

20. The swimming pacing system as claimed in claim 1, further comprising a sensor positionable within the pool and operatively connected to the controller, the sensor being configured to detect a presence of the swimmer at a corresponding location of the sensor.

* * * * *